United States Patent [19]

Arens

[11] Patent Number: 4,590,110

[45] Date of Patent: May 20, 1986

[54] GRID CONSTRUCTION FOR RUNNER OR DOORMAT

[76] Inventor: Erich Arens, Albertstrasse 11, 5900 Siegen, Fed. Rep. of Germany

[21] Appl. No.: 610,242

[22] Filed: May 14, 1984

[30] Foreign Application Priority Data

May 13, 1983 [DE] Fed. Rep. of Germany ..... 3317410

[51] Int. Cl.[4] ..... B32B 3/00

[52] U.S. Cl. ..... 428/53; 428/95; 15/217; 52/181; 52/586

[58] Field of Search ..... 52/177, 180, 181, 660, 52/664, 581, 585, 586, 588, 594; 15/215, 216, 217, 238, 240; 428/98, 99, 100, 101, 53, 54, 55, 56, 95, 61, 62

[56] References Cited

U.S. PATENT DOCUMENTS

| | | | |
|---|---|---|---|
| 3,247,637 | 4/1966 | Robertson | 52/594 |
| 3,783,471 | 1/1974 | McGeary et al. | 15/215 |
| 3,992,839 | 11/1976 | La Borde | 52/588 |
| 4,029,834 | 6/1977 | Bartlett | 52/181 |
| 4,221,833 | 9/1980 | Guillermin et al. | 428/62 |
| 4,381,324 | 4/1983 | Ellingson, Jr. | 52/177 |

FOREIGN PATENT DOCUMENTS

| | | | |
|---|---|---|---|
| 2412151 | 9/1975 | Fed. Rep. of Germany . | |
| 2719857 | 10/1978 | Fed. Rep. of Germany . | |
| 3124529 | 1/1983 | Fed. Rep. of Germany . | |
| 306408 | 11/1968 | Sweden | 52/588 |

*Primary Examiner*—John E. Murtagh
*Assistant Examiner*—Caroline Dennison
*Attorney, Agent, or Firm*—Karl F. Ross; Herbert Dubno

[57] ABSTRACT

A grid designed for use as a runner or a doormat comprises a multiplicity of parallel profiled bars, preferably of plastic, having a generally U-shaped cross-section with two upstanding flanges interconnected at their lower ends by a horizontal web. In certain embodiments each flange has an inverted-Y profile with one arm joined to the web and the other arm diverging therefrom, the two arms defining between them an undercut, downwardly open longitudinal groove which in the case of at least one flange has a cross-section in the shape of an upwardly pointed arrowhead facilitating the introduction, from below, of a substantially complementarily shaped upstanding rib of a connecting member of much shallower U-profile linking a pair of adjoining bars to each other. The underside of the connecting member is either flush with that of the bars or at a slightly lower level. A channel bounded by the two flanges of the bar is also undercut, at approximately the level of the groove undercuts of the inverted-Y profiles, for positive engagement with a complementarily profiled stiffly elastic rail holding a strip of yieldable tread-supporting material projecting upwardly from the rail and the bar to form a part of the upper mat surface.

20 Claims, 5 Drawing Figures

GRID CONSTRUCTION FOR RUNNER OR DOORMAT

FIELD OF THE INVENTION

My present invention relates to the construction of a grid to be used in a mat to be walked upon, e.g. a runner or a doormat.

BACKGROUND OF THE INVENTION

Conventional grids of the type here contemplated include a multiplicity of mutually parallel and equispaced profiled bars, interlinked by transverse connector elements with coupling formations engaged in complementary, undercut grooves of the bars, and tread-supporting or carrier strips of yieldable material such as felt, textile fabric, rubber or bristles which are received in rails of stiffly resilient polymeric material, specifically hard plastic. The rails are thin-walled profiles of generally U-shaped cross-section and interlockingly engage in undercut upwardly open longitudinal channels of respective bars whereby the tread-supporting strips jointly define the upper mat surface.

Such grids, with the complementary grooves formed on the undersides of the bars, are known from my German Pat. No. 24 12 151 and printed specification No. 27 19 857. They have the advantage of convenient assembly and are therefore suitable for manufacture in workshops manned by handicapped personnel.

A drawback of this type of construction resides in the considerable height of the resulting mat which is due to the fact that the grooves accommodating the coupling formations of the connector elements lie well below the levels of the upwardly open channels receiving the strip-supporting rails. In some instances, therefore, the mats can be used only on a suitably recessed floor. While the height of the mat can be reduced by providing the undercut coupling grooves on the sides of the bars rather than on their lower surfaces, as suggested in German published application No. 31 24 529, that solution results in a significant broadening of each bar; besides, the assembly of the parts requires an endwise introduction of the coupling formations into the associated grooves which creates problems for handicapped persons assigned to this task.

OBJECT OF THE INVENTION

Thus, the object of my present invention is to provide an improved grid construction of the general type referred to which obviates the disadvantages of prior structures and can be conveniently assemblied, even by handicapped operators.

SUMMARY OF THE INVENTION

The basic structure of my improved grid essentially conforms to that shown in my two German publicatons, comprising profiled bars, connector means therefor, rails and yieldable thread-supporting or carrier strips substantially as described above. In contrast to the known assemblies, however, the undercuts of downwardly open coupling grooves—of which there is at least one per bar—lie on substantially the same level as the undercuts of the upwardly open channels accommodating the rails. These channels, of cross-sections complementary to those of the rails received therein, are not necessarily formed by the bars themselves but could also lie between adjoining bars, their bottoms being then constituted by the connector means. The spaced-apart bars, being of generally U-shaped cross-section with a pair of upstanding flanges interconnected by a web, thus define with their connector means two interleaved sets of first and second channels, either or both of which could grip the rails holding the yieldable and preferably brushlike carrier strips. The grooves are of significantly narrower and lower cross-sectional area than the channels. An upstanding rib on the connector means extends from below into each groove and terminates in a broadened coupling head fitted into the undercuts of that groove, these undercuts being disposed above an entrance slot lying substantially at the level of the associated web.

Pursuant to a more particular feature of my invention, each of these grooves is formed in a foot of a flange of one of the profiled bars. When both flanges are provided with such grooves, the connector means will be in the form of a multiplicity of individual connecting members extending each between only two adjoining bars, substantially at the level of their webs but possibly projecting slightly (e.g. by 0.5–1 mm) below these webs in order to relieve the profiles from contact with the underlying floor. Alternatively, each connecting member may have only one coupling rib, extending along a free edge thereof for engagement with a single groove of one bar, and may be integral with an adjacent bar, as by extending laterally from an ungrooved flange thereof onto which it may have been molded.

In either case, with the rails (or some of them) occupying the set of first channels formed by the bars themselves, the flanges of each bar are advantageously of generally inverted-Y profile with confronting arms of their inverted Y's elbowed to form the undercuts of these channels serving to interlock with the correspondingly contoured rails. The other arm of the inverted Y, diverging from the elbowed arm and forming therewith the aforementioned foot, may terminate in a re-entrant hook defining with a similar hook of the elbowed arm the entrance slot of the groove. The cross-section of the groove is preferably in the shape of an arrowhead with an upwardly pointing tip. The coupling head of each rib may be longitudinally split into two prongs, with oppositely pointing barbs, which are separated by a slit wide enough to enable a resilient deformation of these prongs facilitating their insertion into the groove through its entrance slot. The rails, as well as the connecting members and the rails holding the carrier strips, could be metallic but preferably consist of polymeric material.

Even when the several profiled bars are spacedly interlinked by connecting elements underlying their webs, the desired location of the undercuts of the channels and of the grooves can be achieved in accordance with my invention by providing each web with a longitudinally extending central pedestal which supports the respective rail and defines with the associated flanges two lateral undercuts engaged by dependent spurs of that rail; the coupling heads of the ribs of the connecting elements are then received in downwardly open undercut grooves formed in the pedestals of the bars. In all these instances, therefore, the coupling heads can be forced into their respective grooves in the manner of pushbuttons by downward pressure, exerted for example on an assembly table on which the parts have been suitably aligned.

BRIEF DESCRIPTION OF THE DRAWING

The above and other features of my invention will now be described in detail with reference to the accompanying drawing in which.

SPECIFIC DESCRIPTION

Figure 1:
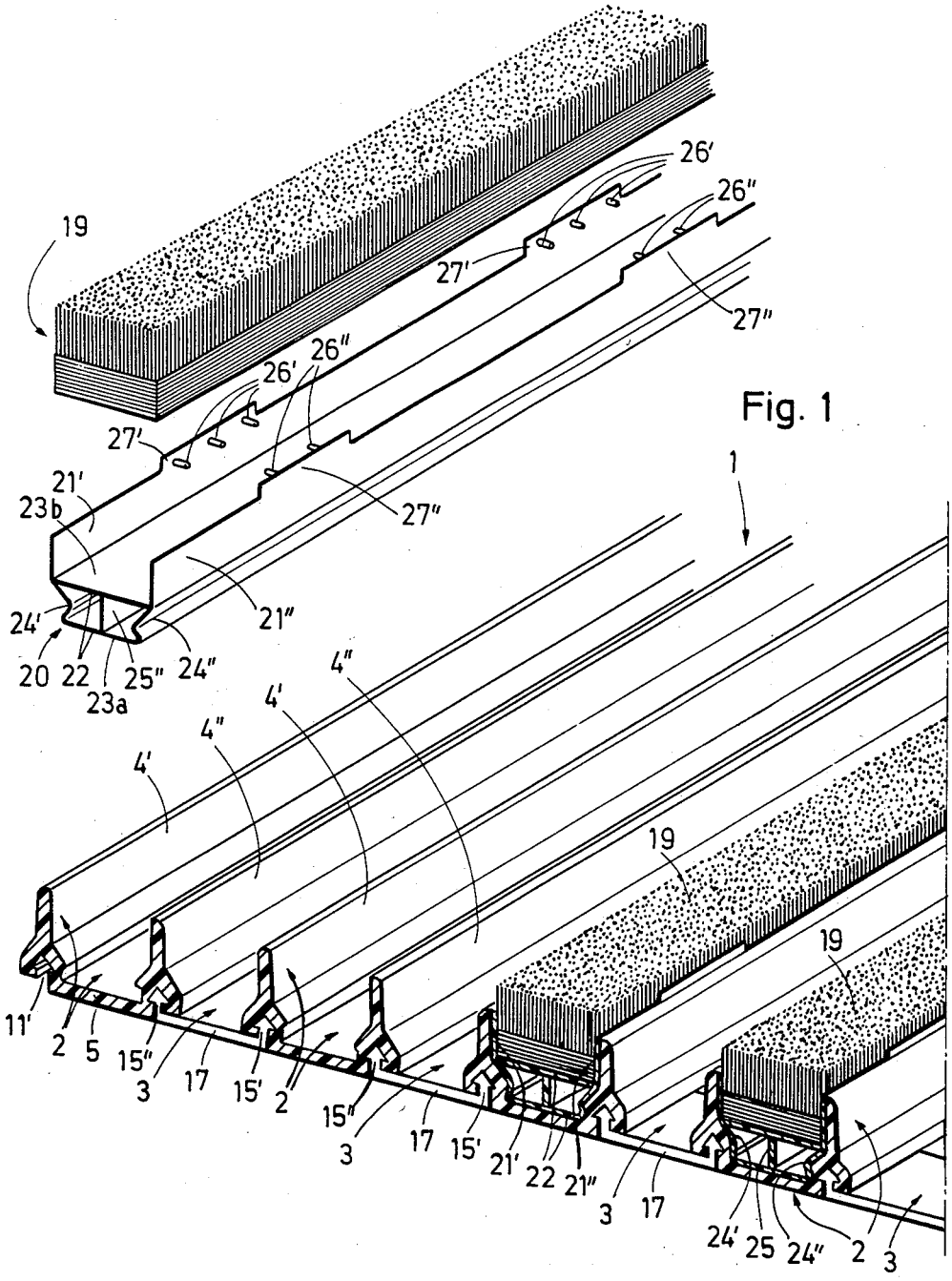
FIG. 1 is a partially exploded perspective view of a representative portion of a mat-forming grid embodying the present improvement.
Figure 2:
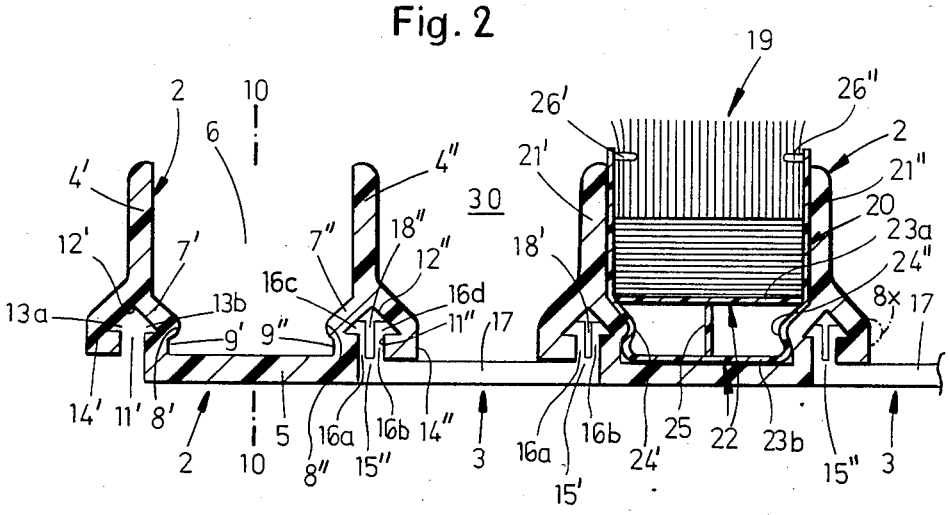
FIG. 2 is a cross-sectional view, drawn to a larger scale, of two profiled bars (one of them fitted with a strip-carrying rail) and an intervening connecting member forming part of the assembly of FIG. 1.

As illustrated in FIGS. 1 and 2, a grid 1 according to my invention comprises a multiplicity of parallel, elongate bars 2 which advantageously are extruded from a substantially rigid plastic material. The bars 2 are spacedly joined together by strip-like transverse connecting members 3, also preferably made of shape-retaining plastic, which may be cut from an extruded profile of generally shallow U-shaped cross-section with bight portions 17 and ribs 15', 15" rising from opposite edges thereof. Each bar 2, whose generally U-shaped cross-section is much deeper than that of the connecting members 3, has a bight portion formed by a web 5 and a pair of upstanding parallel flanges 4', 4", both substantially of inverted-Y profile with arms 7', 14' and 7", 14" at their feet. The web and the flanges together define a longitudinal channel 6 which is undercut at 9', 9", just above the web 5, by elbow-shaped bends 8', 8" in the confronting arms 7', 7" of the inverted-Y profiles. These confronting arms 7, 7", which merge into the web 5, form re-entrant hooks which with similar hooks of the outwardly diverging, cantilevered arms 14', 14", having undersides on the level of the upper surface of web 5, bound a downwardly open entrance slot of a respective groove 11', 11" within the foot of each flange. Just above that entrance slot, the grooves have undercuts **13*a*, 13*b* which lie substantially at the level of the undercuts 9', 9" of channel 6 and define an arrowhead-shaped groove profile with an upwardly pointing tip 12', 12". The undercut channels 6 interlockingly accommodate respective rails 20 carrying brushlike tread-supporting strips 19**, as more fully described hereinafter.

The ribs 15', 15" of each connecting member 3, linking two adjoining bars 2 such as those shown in FIG. 2, have coupling heads matingly fitting into grooves 11', 11" upon being introduced into same from below. The coupling head of each rib 15', 15" is split by a longitudinal slit 18', 18" into two prongs **16*a*, 16*b* provided with oppositely pointing barbs 16*c*, 16*d* which engage in the undercuts 13*a*, 13*b* of the respective groove upon clearing the entrance slot in which they were elastically pressed together. The prongs 13*a*, 13*b* can therefore be readily forced into these grooves by a downward pressure upon each bar 2 properly aligned with connector members 3 under-reaching the feet of its flanges 4', 4"**.

The channels 6 formed by bars 2 alternate with other channels 30 of the same length defined between a flange 4' of one bar and a flange 4" of an adjacent bar, the bottoms of these latter channels being represented by the bight portions 17 of the connecting members 3 interlinking these bars. The outer arms 14', 14" of each flange could also be elbowed, in a manner symmetrical to that of the corresponding inner arms 7', 7", as indicated in phantom lines at **8*x* in FIG. 2. Thereby the inter-bar channels 30 will also be provided with undercuts so as to be able to accommodate rails 20 holding tread strips 19. If desired, such strip-holding rails could then be installed in half the length of each channel 6 and, offset therefrom, in half the length of each channel 30** to form a staggered pattern.

It will be noted that, in the embodiment of FIGS. 1 and 2, the undersides of bars 2 and connecting members 3 are flush with one another to form a continuous lower mat surface coming to rest on an underlying floor. Also, bight portions 17, webs 5, ribs 15', 15" as well as the stems and the arms of the inverted Y's of flanges 4', 4" are all of the same thickness which simplifies their manufacture by injection molding. The bars are entirely symmetrical about their longitudinal vertical midplanes 10—10.

Each rail 20 has a generally U-shaped cross-section, complementary to that of channels 6 (or 30 in the alternative case discussed above), defined by two parallel lateral walls 21', 21" and a hollow base 22. Base 22 comprises an upper wall **23*a*, a lower wall 23*b* and two inbent sidewalls with bends 24', 24" hugging the elbowed arms 7', 7" of the flanges 4', 4" by which they are thus positively retained. A central partition 25 in the aforementioned midplane reinforces the base by bracing the horizontal walls 23*a*, 23*b*** against each other. The profile of the base can be described as roughly double-trapezoidal, with the two trapezoids diverging from each other.

Lateral walls 21', 21" terminate substantially at the upper edges of flanges 4', 4", except for a number of tabs 27', 27" which rise above these edges at several longitudinally separated locations and support confronting groups of horizontal detent pins 26', 26" with a certain longitudinal offset, i.e. a staggering by half a pin spacing, as clearly seen in FIG. 1. These detent pins project from opposite sides into the inserted carrier strip 19, here specifically into a pile of bristles projecting from each channel 6, to hold it in place. The bristles are anchored to a bottom layer resting directly on base 22; a three-layer insert, as described hereinafter with reference to FIGS. 4 and 5, could also be used.

The rails 20 can be unitarily injection-molded, with small wall thickness as shown, from hard plastic of limited resiliency sufficient to allow for an elastic deformation of the lower part of base 22 to clear the elbows 8', 8" upon forced introduction into channels 6 from above.

Figure 3:
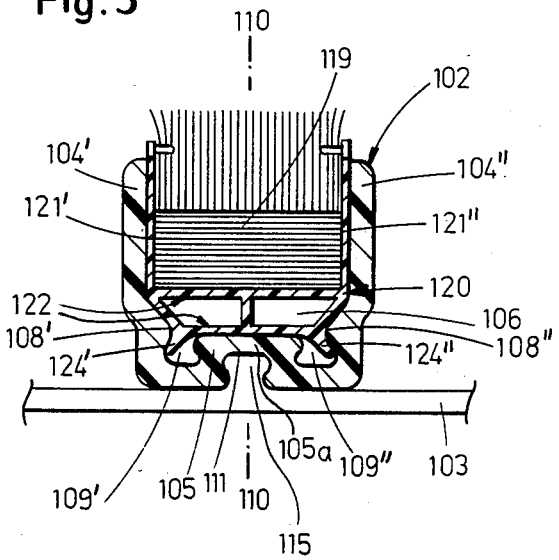
FIG. 3 is a cross-sectional view similar to that of FIG. 2, illustrating another embodiment.

In FIG. 3 I have illustrated a modified profiled bar 102, symmetrical about a vertical midplane 110—110, with upstanding flanges 104', 104" and a web 105 formed with a central, longitudinally extending pedestal **105*a* defining a channel 106 similar to the channels 6 of the preceding embodiment. Flanges 104', 104" are inbent at 108', 108" to form with pedestal 105*a* a pair of symmetrical undercuts 109', 109" which lie at substantially the level of an undercut part of a downwardly open central longitudinal groove 111 of generally dovetail-shaped cross-section interlockingly engaged by a rib 115 of an underlying striplike connecting member 103; the latter, unlike the members 3 of FIGS. 1 and 2, extends as part of a group of such members across all the bars 102 to link them together. Channel 106 is occupied by a rail 120 with lateral walls 121', 121" and a hollow base 122 resting on pedestal 105***a*. The profile of that base is a single, downwardly converging trapezoid whose sidewalls are extended by respective spurs 124', 124" interlockingly engaging in the respective undercuts 109', 109". Rail 120, which otherwise resembles the rails 20 of the preceding Figures, engages a brushlike carrier strip 119 in the manner already described.

Although in this instance the bars 102 lie on top of the connecting members 103, the overall height of the resulting mat does not differ significantly from that of the grid 1 shown in FIG. 1 inasmuch as undercuts 109', 109" are no farther from the floor than their counterparts in bars 2.

Figure 4:
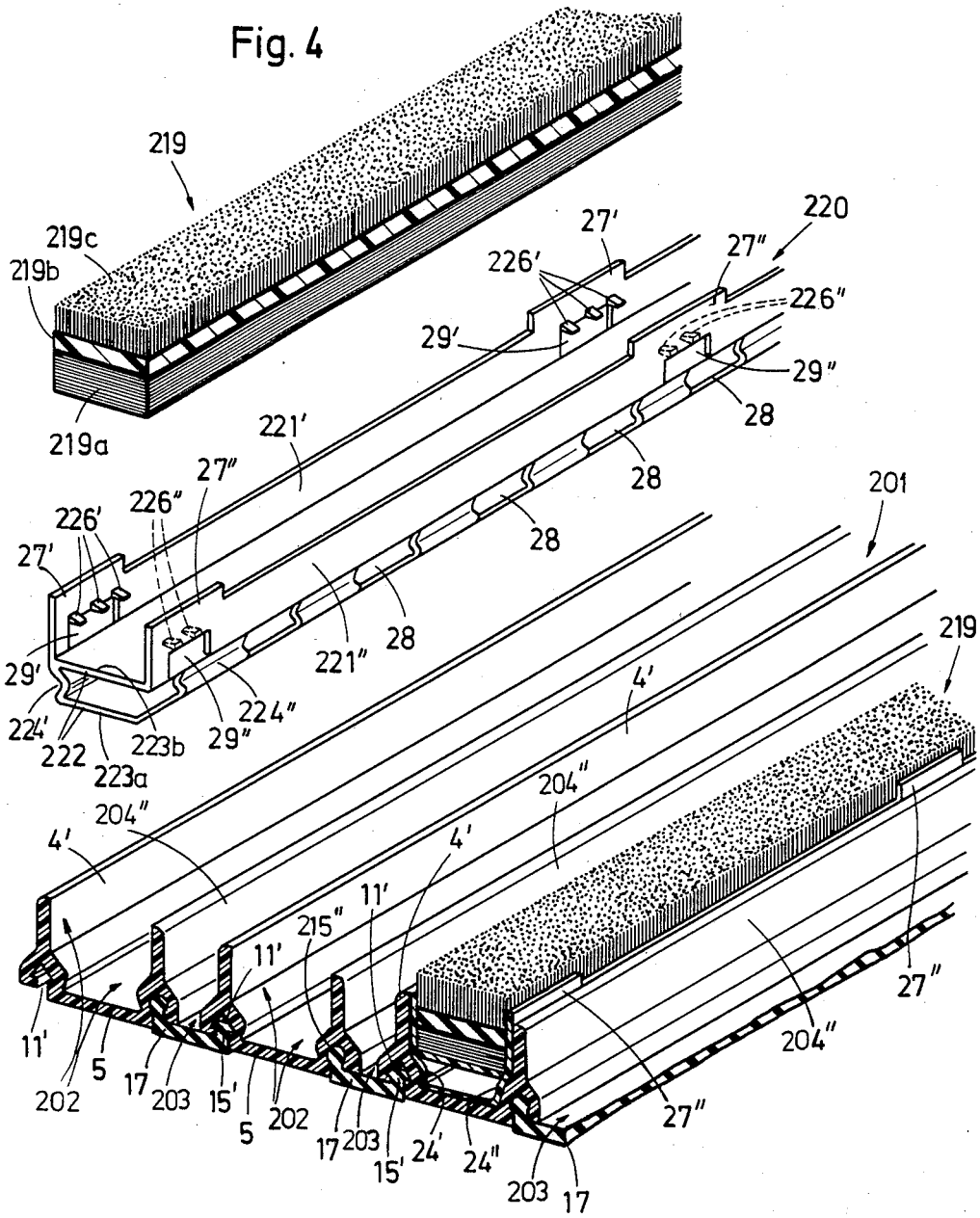
FIG. 4 is a view similar to that of FIG. 1, pertaining to a further embodiment.
Figure 5:
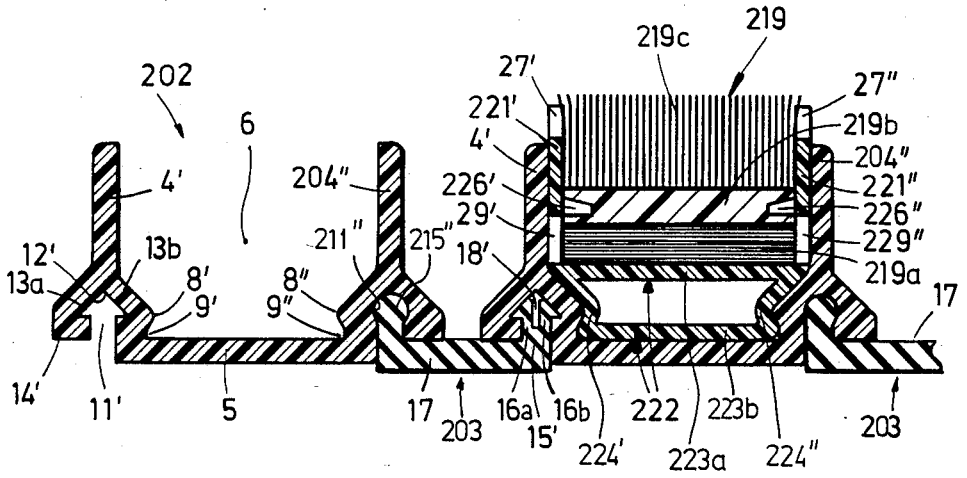
FIG. 5 is a cross-sectional view analogous to that of FIG. 2 but relating to the embodiment of FIG. 4.

FIGS. 4 and 5 relate to a modified grid 201 whose profiled bars 202 are similar to bars 2 of FIGS. 1 and 2, except that they are no longer symmetrical about a midplane since the inverted-Y profile of one flange 204" differs somewhat from that of its mate 4' which has the same shape as before. Thus, the foot of flange 204" has a groove 211" of round cross-section permanently occupied by a complementary coupling head of a rib 215" of a connecting member 203 which also has an unsymmetrical profile, its other rib 15' having the same configuraiton as in the embodiment first described. Each member 203, furthermore, is longitudinally coextensive with the two bars interconnected thereby instead of being a segment extending over only a fraction of their length. Moreover, the bight portions 17 of members 203 are heavier than the webs 5 of bars 202 whereby their undersides lie below those of the webs so that the mat rests only on these members, at least when not stepped on. The level difference between the lower surfaces of bight portions 17 and webs 5 is preferably about 1 mm or a fraction thereof.

The connecting members 203 may consist of a softer polymeric material than the bars 202, e.g. of natural rubber free from plasticizer. Such a material has a high slip resistance and does not leave unsightly plasticizer-caused stains on an underlying polished stone floor. The downwardly projecting members 203 also prevent a scratching of the floor surface by the harder bars 202 when the mat is installed or removed. Each bar 202 may be extruded jointly with an associated connecting member 203, disposed to the right thereof in FIG. 5, to form therewith a unitary body which has but one rib 15' to be inserted from below into an undercut groove 11" of an adjacent body. The horizontal part 17 of member 203 could also be molded directly onto a bar 202 integrated therewith, the rib 215" being omitted; such a junction, however, may be less stable.

In FIGS. 4 and 5 I have also shown a modified carrier strip 219 composed of a lowermost layer 219*a*, an intermediate adhesive layer 219*b* and an uppermost brush layer 219*c* with bristles anchored in layer 219*b*. The base layer 219*a* advantageously consists of a decay-resistant plastic material such as polyurethane or polyethylene. Such an insert has a high degree of elasticity, structural stability and moisture tolerance so as to be particularly suitable for outdoor use.

Each strip 219 is held in a modified rail 220 with a base 222 whose sidewalls with bends 224', 224", as particularly illustrated for the latter sidewall in FIG. 4, have longitudinally spaced-apart and relatively staggered gaps 28 for the sake of increased elasticity; bracing partition 25 has been omitted for the same purpose. Detents 226', 226" on lateral walls 221', 221" are here constituted by integral projections of these walls; to facilitate their molding by injection, walls 221' and 221" have cutouts 29', 29" immediately below these detents through which transversely movable plungers coacting with a vertically retractable core can be withdrawn preparatorily to the opening of the mold. The detents still lie at locations marked by upwardly projecting tabs 27', 27" but at a substantially lower level than before, in order to be insertable into the intermediate layer 219*b* of carrier strip 219 rather than into its pile of bristles 219*c*. The tabs, longer than the cutouts, avoid any undue weakening of the walls.

It will be understood that features from different embodiments may be interchanged within the limits of compatibility. Thus, for example, the connecting members 3 of FIGS. 1 and 2 may be replaced by those shown in 203 in FIGS. 4 and 5, or vice versa. The rails 220 with their inserts 219 could be used in the bars 2 of FIGS. 1 and 2, or the inserts 219 alone may replace the carrier strips 119 in the bars 102 as shown in FIG. 3.

I claim:

1. A grid for a mat to be walked upon, comprising:

a multiplicity of mutually parallel and equispaced horizontal bars of elastic material having a generally U-shaped cross-section with pairs of upstanding flanges defining between them a set of first upwardly open longitudinal channels, confronting flanges of ajoining bars defining between them a set of second upwardly open longitudinal channels, the flanges of each bar being interconnected by a web having an upper surface, each bar being formed with at least one groove of significantly smaller cross-sectional area than said channels, said groove being undercut above a downwardly open entrance slot extending upwardly from substantially the level of the upper suface of said web;

a multiplicity of rails of generally U-shaped cross-section complementary to that of the channels of at least one of said sets, said rails respectively occupying the complementarily cross-sectioned channels;

a multiplicity of tread strips respectively received in said rails and projecting therefrom above the upper edges of said flanges; and elongated U-section connectors extending the full lengths of said bars and interlinking said bars and forming bottoms of said second channels extending all along said second channels, said connectors being provided with upstanding ribs respectively extending from below into the grooves of said bars continuously over the lengths thereof and terminating in broadened coupling heads fitted into the undercuts of said grooves, said complementarily cross-sectioned channels having undercuts substantially at the level of the undercuts of said grooves.

2. A grid as defined in claim 1 wherein at least one flange of one of said bars is provided with a foot and each of said grooves is formed in a respective said foot.

3. A grid as defined in claim 2 wherein said rails occupy said first channels, the flanges of each bar being of generally inverted-Y profile with confronting arms of their inverted Y's elbowed to form the undercuts of the first channel defined thereby.

4. A grid as defined in claim 3 wherein said foot is formed by the elbowed arm and by another arm of the inverted Y diverging therefrom but terminating in a re-entrant hook which with a similar hook of the elbowed arm defines said entrance slot, said groove being of substantially arrowhead-shaped cross-section with an upwardly pointing tip.

5. A grid as defined in claim 4 wherein the coupling head of each of said ribs is longitudinally split into two prongs with oppositely pointing barbs which are separated by a slit sufficiently wide to enable a resilient deformation of said prongs facilitating their insertion into a respective one of said grooves through the entrance slot thereof.

6. A grid for a mat to be walked upon, comprising:

a multiplicity of mutually parallel and equispaced horizontal bars of elastic material having a generally U-shaped cross-section with pairs of upstanding flanges defining between them a set of first upwardly open longitudinal channels, confronting flanges of adjoining bars defining between them a set of second upwardly open longitudinal channels, the flanges of each bar being interconnected by a web, each bar being formed with at least one groove of significantly smaller cross-sectional area than said channels, said groove being undercut above an entrance slot lying substantially at the level of said web;

a multiplicity of rails of generally U-shaped cross-section complementary to that of the channels of at least one of said sets, said rails respectively occupying the complementarily cross-sectioned channels;

a multiplicity of tread strips respectively received in said rails and projecting therefrom above the upper edges of said flanges; and connector means interlinking said bars and forming the bottoms of said second channels, said connector means being provided with upstanding ribs respectively extending from below into the grooves of said bars and terminating in broadened coupling heads fitted into the undercuts of said grooves, said complementarily cross-sectioned channels having undercuts substantially at the level of the undercuts of said grooves, at least one flange of one of said bars is being provided with a foot and each of said grooves is formed in a respective said foot, said rails occupying said first channels, the flanges of each bar being of generally inverted-Y profile with confronting arms of their inverted Y's elbowed to form the undercuts of the first channel defined thereby, said foot being formed by the elbowed arm and by another arm of the inverted Y diverging therefrom but terminating in a re-entrant hook which with a similar hook of the elbowed arm defines said entrance slot, said groove being of substantially arrowhead-shaped cross-section with an upwardly pointing tip, the coupling head of each of said ribs being longitudinally split into two prongs with oppositely pointing barbs which are separted by a slit sufficiently wide to enable a resilient deformation of said prongs facilitating their insertion into a respective one of said grooves through the entrance slot thereof, said connector means comprising a multiplicity of individual connecting members extending each between only two of said bars substantially at the level of the webs thereof.

7. A grid as defined in claim 6 wherein said connecting members have undersides lying slightly below those of said webs.

8. A grid as defined in claim 6 wherein the flanges of each bar are symmetrically profiled and are formed with two mutually identical downwardly open grooves of said arrowhead-shaped cross-section, said connecting members being each provided with two of said upstanding ribs extending along parallel edges thereof to form a U-profile substantially shallower than that of said bars.

9. A grid as defined in claim 8 wherein said connecting members, said ribs, said webs, said arms and the parts of said flanges above said arms are all of substantially the same thickness.

10. A grid as defined in claim 1 wherein the web of each bar has a longitudinally extending central pedestal supporting a respective rail and defining with the associated pair of flanges two lateral undercuts engaged by depending spurs of said rail, said groove being formed on the underside of said pedestal.

11. A grid as defined in claim 6 wherein each connecting member is integral with an adjoining bar and extends laterally from a flange thereof lacking a downwardly open groove.

12. A grid for a mat to be walked upon, comprising:

a multiplicity of mutually parallel and equispaced horizontal bars of elastic material having a generally U-shaped cross-section with pairs of upstanding flanges defining between them a set of first upwardly open longitudinal channels, confronting flanges of adjoining bars defining between them a set of second upwardly open longitudinal channels, the flanges of each bar being interconnected by a web, each bar being formed with at least one groove of significantly smaller cross-sectional area than said channels, said groove being undercut above an entrance slot lying substantially at the level of said web;

a multiplicity of rails of generally U-shaped cross-section complementary to that of the channels of at least one of said sets, said rails respectively occupying the complementarily cross-sectioned channels;

a multiplicity of tread strips respectively received in said rails and projecting therefrom above the upper edges of said flanges; and connector means interlinking said bars and forming the bottoms of said second channels, said connector means being provided with upstanding ribs respectively extending from below into the grooves of said bars and terminating in broadened coupling heads fitted into the undercuts of said grooves, said complementarily cross-sectioned channels having undercuts substantially at the level of the undercuts of said grooves, at least one flange of one of said bars is being provided with a foot and each of said grooves is formed in a respective said foot, said rails occupying said first channels, the flanges of each bar being of generally inverted-Y profile with confronting arms of their inverted Y's elbowed to form the undercuts of the first channel defined thereby, each of said rails having a hollow base, with a bottom wall, a top wall and two inbent sidewalls hugging the confronting arms of the associated flanges, and two lateral walls rising from the sidewalls of said base to substantially the tops of said flanges.

13. A grid as defined in claim 12 wherein said base is further provided with an internal central partition disposed between said bottom and top walls as a reinforcement therefor.

14. A grid as defined in claim 12 wherein said sidewalls have longitudinally spaced-apart gaps for increased elasticity.

15. A grid as defined in claim 12 wherein said lateral walls are provided with inwardly projecting detents holding the respective tread-supporting strip in position on the rail.

16. A grid as defined in claim 15 wherein said tread strip includes a decay-resistant lowermost layer, an intermediate adhesive layer, and an uppermost layer of upstanding bristles anchored to said intermediate layer, said detents projecting into said intermediate layer, said lowermost and intermediate layers being flanked by said lateral walls.

17. A grid as defined in claim 15 wherein said lateral walls are formed with upstanding tabs rising from their upper edges at locations spaced in longitudinal direction thereof, said detents being disposed in groups at said locations.

18. A grid as defined in claim 17 wherein confronting groups of said detents are relatively offset in said longitudinal direction.

19. A grid as defined in claim 18 wherein said rails consist of moldable polymeric material and said detents are projections molded integrally therewith, said lateral walls having cutouts immediately below said detents enabling their formation by injection-molding.

20. A grid as defined in claim 17 wherein said tabs project above said flanges.

* * * * *